United States Patent [19]

Lehmann

[11] 4,273,248

[45] Jun. 16, 1981

[54] SHAPED CAPS AND CONTAINERS

[75] Inventor: Myrtil B. Lehmann, Saint Cloud, France

[73] Assignee: Chanel, Neuilly-sur-Seine, France

[21] Appl. No.: 55,487

[22] Filed: Jul. 6, 1979

[30] Foreign Application Priority Data

Jul. 7, 1978 [FR] France ..... 78 20257

[51] Int. Cl.[3] ..... B65D 51/18

[52] U.S. Cl. ..... 215/331; 215/334

[58] Field of Search ..... 215/277, 305, 295, 303, 215/331, 334, 329, 330, 332, 321, 339; 220/288, 256

[56] References Cited

U.S. PATENT DOCUMENTS

| | | | |
|---|---|---|---|
| 1,727,938 | 9/1929 | Rontsch . | |
| 2,476,155 | 7/1949 | McKelvy | 215/295 |
| 2,628,735 | 2/1953 | McGowan | 215/331 X |
| 2,659,510 | 11/1953 | Jung | 215/341 X |
| 2,716,504 | 8/1955 | Martin | 215/341 X |
| 2,847,139 | 8/1958 | Christiansson et al. | 215/329 X |
| 3,064,844 | 11/1962 | Hoffmann | 215/321 |
| 3,315,830 | 4/1967 | Flynn | 215/334 |
| 3,425,579 | 2/1969 | Brann et al. | 215/329 |
| 3,581,926 | 6/1971 | Roder | 215/330 |
| 3,667,642 | 6/1972 | Blan et al. | 220/288 |
| 3,815,776 | 6/1974 | MacMillan | 220/288 X |
| 3,973,941 | 8/1976 | Angeri | 215/31 X |
| 4,093,096 | 6/1978 | Angros | 215/331 X |

FOREIGN PATENT DOCUMENTS

| | | | |
|---|---|---|---|
| 109493 | 4/1968 | Denmark | 215/331 |
| 1560099 | 3/1969 | France | 215/331 |

*Primary Examiner*—Allan N. Shoap

*Attorney, Agent, or Firm*—Armstrong, Nikaido, Marmelstein & Kubovcik

[57] ABSTRACT

An abutment face is provided in or adjacent the shoulder of a bottle or other container onto the neck of which a cap is screwed to seal the bottle. The cap has two parts—an inner part which screw-threadedly engages the neck and resiliently seals with it; and an outer part which is in driving engagement with the inner part. In order to ensure proper orientation of the outer part with the body of the bottle (if for example a flat surface on the outer part is to be aligned with a flat surface on the body of the bottle) while still ensuring a seal between the inner part and the bottle, a stop face is provided inside the outer part and, when the inner part has already sealed, abuts with the abutment face to cause such orientation. Upon initial capping of the bottle, the inner part is screwed tight onto the neck and the outer part is then forced over the inner part in a proper orientation until engagement between them is established.

9 Claims, 4 Drawing Figures

SHAPED CAPS AND CONTAINERS

FIELD OF THE INVENTION

The present invention relates to the positioning of a cap on a container and is intended particularly but not exclusively to be applied to perfume bottles.

BACKGROUND OF THE INVENTION

It is known that most bottles are closed by a cap which screws onto the neck or spout, a liquid-tight seal being placed between the upper part of the neck of the bottle and the inside ring of the cap. Closure is obtained by a helical movement (rotating plus translation), of the cap on the neck. During the closing of the bottle the seal flattens, thus braking the translation movement whilst the rotary movement can continue as a function of the force couple exerted on the cap. It is found that in relation to the body of the bottle, the rotational orientation of the cap when the bottle is fully closed can vary over an angle which is of the order of 90°, this angle depending of course on the pitch of the thread and the compressibility of the seal.

This fact is not a significant disadvantage when the cap and the bottle are rotationally symmetrical. It is not the same when the bottle and/or the cap have polygonal sections, for example, square ones. More often than not in that case the cap is out of line, which distinctly spoils the appearance of the whole.

In the perfume industry, the product in the bottle being by definition very volatile, it is essential to arrange for a closure which ensures a perfect fit. To this end, it has been known to arrange inside the cap proper a skirt with external fluting and internal threading which, by resilient deformation absorbs the differences in dimensions arising from manufacture and ensures fluid-tightness by close contact with the material of the bottle.

SUMMARY OF THE INVENTION

An object of the invention is to realise a simple device which ensures a specified orientation of the outside of the cap relative to the body of the container.

It is a further object of the invention to provide a positioning device for a cap on a container which is effective to orientate the cap at a time when a vapour-tight seal has been established between the cap and the container.

It is yet a further object of the invention to provide a positioning device effective between a container and a two-part cap the inner part of which forms the seal with the container and the outer part of which forms a driving engagement with the inner part and also has a stop member for defining, with an abutment member on the container, the said predetermined orientation.

It is a yet further object of the invention to provide a two-part cap for a container in which, on assembly, an inner part first forms a sealing engagement with the container and the outer part is then pushed axially into driving engagement with the inner part in an orientation determined by abutment elements on the container and the outer part of the cap.

More specifically, an internally screw-threaded cap for screwing onto the neck of a bottle has at its lower end (the end nearest to the body of the bottle) an inwardly-extending face. At the shoulder of the bottle there is an outwardly extending face. When the cap is screwed down onto the neck, the two faces come into abutment and block further rotation of the cap as a whole.

Thus, the translational movement of the cap having been more or less stopped by the braking action of the neck on the seal or the fluted skirt, the rotational movement is blocked by the abutment. One can then be sure that the cap will stop in a predetermined orientation in relation to the body of the bottle.

When the cross-sections of the bottle and the cap are polygonal, e.g. being substantially square, the abutment face preferably extends in the direction of a diagonal plane of the bottle. The cross-sectional outlines of the cap and the body of the bottle may of course be the same or different but the cross-section area through the cap will usually be not greater than that of the body of the bottle.

Other characteristics and advantages of the invention will appear in the course of the description which follows.

DESCRIPTION OF A PREFERRED EMBODIMENT

Figure 1:
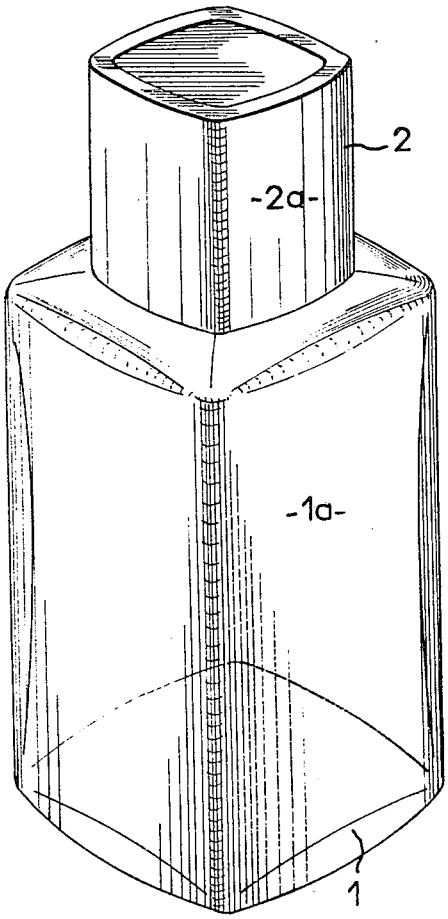
FIG. 1 is an external view of a bottle actually on the market, which does not differ in its external appearance from a bottle embodying the invention.

FIG. 1 shows one type of bottle actually on sale, which does not differ externally from a bottle provided with a device according to the invention. This bottle has a body 1 and a cap 2 screwed onto the body 1. The problem which is solved by the invention is that of ensuring that the side 1*a* of the body of the bottle will finish up parallel with side 2*a* of the cap after the cap has been unscrewed from the bottle and then screwed on again.

Figure 2:
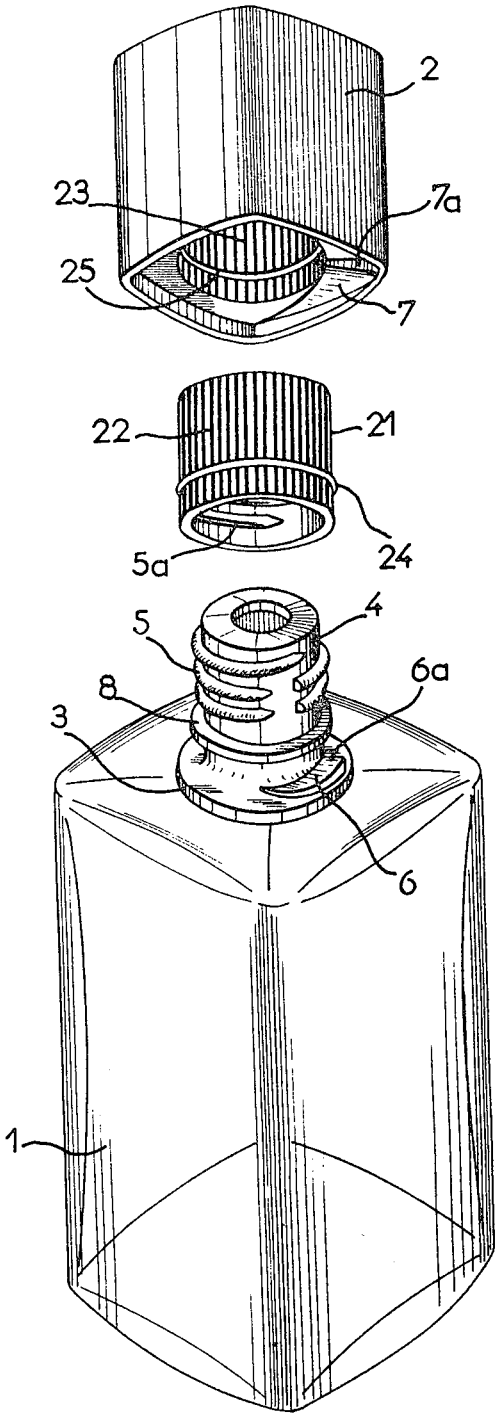
FIG. 2 is a view of a bottle embodying the invention, the cap being separated from the body of the bottle.

As is shown more clearly in FIG. 2, this problem is solved by forming on the shoulder of the bottle an abutment surface able to cooperate with a stop element formed in the outer part of the cap 2. It can be seen in FIG. 2 that the body 1 is joined by means of a flange 3, forming part of the shoulder, to a neck 4. The neck 4 is threaded, the threads 5 being able to cooperate with a threading 5*a* inside the inner part of the cap 2 which is a capsule 21 having external flutes 22 which by cooperating with corresponding ridges in the outer part ensure that the outer part of the cap and the skirt are drivingly engaged together. A rib 8 ensures the centering of the cap on the neck. As is shown in FIG. 2, thickening 6 upstanding on the flange 3 has a vertical, generally radially directed, abutment face 6*a*. This abutment face 6*a* cooperates during the closing of the bottle with a vertical, generally radially directed, face of a stop element 7 formed inside and at the bottom part of the outer part of the cap. During the screwing of the cap onto the neck, the cap and therefore the stop part turn freely about the neck until, following the translational movement of the cap, the face 7 of the stop part comes into contact with the face 6*a* of the thickening 6. Further rotary movement is thus blocked, which ensures the desired orientation of the cap relative to the body of the bottle.

It will now be immediately apparent that the abutment face 6a need not be provided on an upstanding thickening of the flange but could be provided by the end-face of a recess formed axially downwardly (i.e. towards the body) within the flange.

Vapour-tightness of the closing can be assured by various conventional means, e.g. a cork seal plus flexible plastic stopper or self-sealing lips with possible addition of an insert of the dropping tube type.

At all events, it is necessary that the vapour-tightness is produced during the screwing of the fluted capsule 21.

Figure 3:
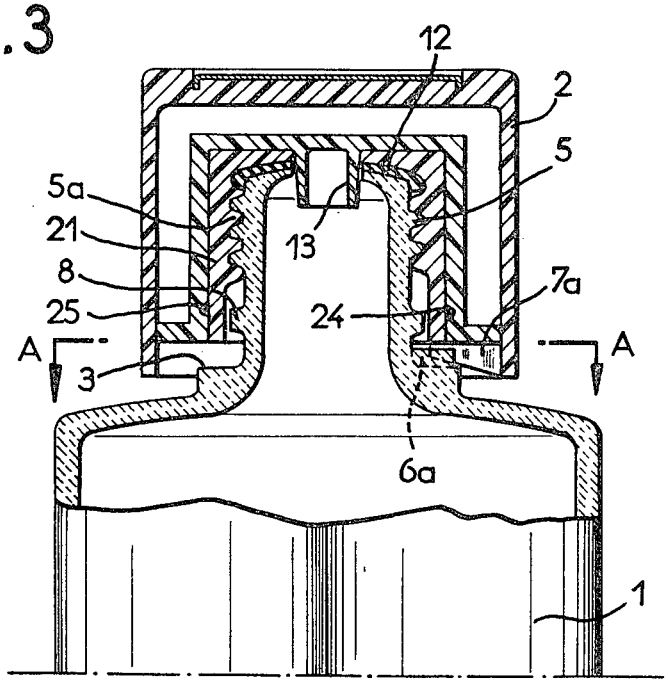
FIG. 3 is a partial section of the upper end of the bottle of FIG. 2 and of the cap.
Figure 4:
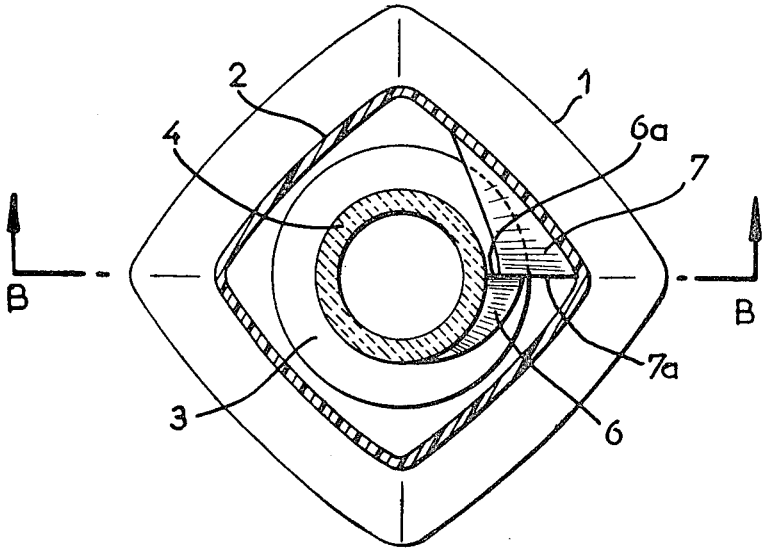
FIG. 4 is a sectional view along the line A—A of FIG. 3.

FIGS. 3 and 4 are sections respectively along the line B—B of FIG. 4 and along the line A—A of FIG. 3, showing the cap in position and sealing the neck of the bottle. It can be seen in these figures that the face 7a of the stop part 7 abuts against the face 6a of the thickening 6. The seal 12 ensures the liquid-tightness in cooperation with the teat or insert 13.

Although in the example shown the rotary movement of the cap is stopped by a single abutment, it is obvious that on the flange 3 or on the shoulder proper several thickenings (or recesses) can be provided, cooperating during closing with respective stop faces formed inside the cap. Of course, the form of the bottle and of the cap does not limit the present invention. It is particularly applicable to polygonal caps and bottles, especially rectangular or square ones (when the stop and abutment faces will preferably extend diagonally) but can be put into operation for example with a cap generally cylindrical in shape and having a flat which one wants to be certain will be placed exactly as an extension of the label on a face of the bottle, with the aim of ensuring repetition of the original presentation of the whole.

The capsule 21 which is the inner part of the cap and which ensures vapour-tightness is made in a more flexible material than the outer part of the cap 2. In fact, it should react to the different forces which act on it and the insert 13 should penetrate inside the neck of the bottle and bear on the internal cylindrical face thereof to ensure vapour- and liquid-tightness.

The initial stoppering of the bottle in the factory is done after filling the latter in two stages, namely 1. putting in place the fluted capsule 21 by rotating it about the neck until a suitable sealing contact is obtained between an element of its internal surface (for example a resilient seal part) and the neck of the bottle;

2. putting in place the external cap around the capsule by an axial movement over the latter until it snaps into place by a retaining ring 24 coming into a channel 25; the orientation being the desired one in such a way that the face or faces of the outside of the cap are aligned with the desired face or faces of the bottle.

The abutment face and the stop element are formed such that the orientation is also one in which they abut.

If necessary, during this initial filling the outer part of the cap can undergo a slight rotation relative to the capsule 21 to ensure that the stop part comes into contact with the abutment, which is possible in spite of the flutings or groovings on the capsule 21 on account of the flexibility of the material of the latter. Thus, the position of the outer part cap in relation to the internal skirt in its sealing position is defined exactly.

For the user of the product contained in the bottle, everything goes on as if the cap were unitary since, during rotation in the unscrewing direction, the internal skirt is driven through its flutings or groovings by the external cap.

During reclosing, the internal skirt recovers its liquid-tight position during the last turn of the screw and the rotary movement is automatically blocked in the desired orientation by the abutment.

It will be noted, and this is shown very clearly in FIG. 1, that the skirt of the cap 2 completely masks the device of the invention when the bottle is sealed by the cap.

It goes without saying that modifications can be brought to the method of embodiment which has just been described, notably by substituting equivalent techniques without going outside the spirit or scope of the present invention in order to do it.

I claim:

1. In a container having a non-circular container body and a non-circular cap and guide means for ensuring repeatable helical movement of the cap about an axis of rotation and relative to the container body during sealing of an outlet of the container by the cap, the improvement comprising abutment means on the container and stop means on the cap, the abutment means and stop means comprising respective faces repeatably cooperating to define a predetermined orientation of the cap relative to the body of the container at the termination of the said helical sealing movement and said cap being a two-part cap having an inner and an outer part, the inner part engaging with the container by said guide means and the outer part being separate from the inner part, driving means for interengaging the inner and outer parts and for permitting relative slippage between the same, said driving means comprising a first portion on said outer part and a second portion on said inner part, said outer part bearing said stop means and said inner part including sealing means for sealing the outlet.

2. The improvement as claimed in claim 1 wherein the inner part is made of deformable material and seals the outlet by deformation.

3. The improvement as claimed in claim 1 wherein the inner part includes a deformable seal element.

4. The improvement as claimed in claim 2 or claim 3 wherein the inner part includes an insert for passing into the outlet of the container to seal the said outlet.

5. The improvement as claimed in claim 1 wherein the face of the abutment means is defined by an end face of an upstanding thickening, extending axially of the said axis, of a shoulder of the container.

6. A container comprising a container body, a hollow cylindrical neck extending from the body, screw-threading externally of the neck, a cap engaged on the neck by said screw-threading, an outlet from the container at the end of the neck remote from the body, the cap having an inner part and a separate outer part, the cap inner part being internally screw-threaded to cooperate with the said screw-threading of the neck to induce movement of said cap along a helical path about said neck when the cap is rotated and the cap inner part also comprising yieldable means for sealing the outlet, the cap outer part comprising means for drivingly engaging the cap inner part for rotation of the two cap parts together in their helical path and also comprising a stop face projecting radially toward the neck and at an end portion of the cap outer part adjacent the body of the container, and an abutment face projecting radially outwardly from the neck of the container into the helical path of the stop face in a final revolution only of the latter, whereby to block revolution of the cap in a repeatable predetermined orientation of the latter relative to the body of the container when said cap inner part sealing means are sealing the outlet, said means for drivingly engaging comprises axially aligned splines on said inner part and said outer part, which cooperatively interact for rotation of the two cap parts and permit relative slippage between the same.

7. A container according to claim 6 which is a substantially square-section glass bottle, the outer part of the cap has at least one planar side face to be orientated in alignment with a face of the square-section bottle, and the abutment and stop faces extend generally diagonally of the square-section.

8. A method of capping a container as defined in claim 6 comprising (a) screwing the cap inner part onto the neck of the bottle until sealing is achieved and (b) placing the cap outer part over the inner cap part by an axial movement until the two parts are snap-fitted together to establish driving engagement between them and to establish abutting relationship between the stop and abutment faces.

9. A method according to claim 8 which includes optionally rotating the cap outer part relative to the cap inner part with slippage of the driving engagement to establish said abutting relationship.

* * * * *